United States Patent [19]

Suhre

[11] Patent Number: 4,487,172

[45] Date of Patent: Dec. 11, 1984

[54] SLEEVE VALVE INTERNAL COMBUSTION ENGINE

[76] Inventor: James R. Suhre, P.O. Box 236, Edwardsville, Ill. 62025

[21] Appl. No.: 468,708

[22] Filed: Apr. 12, 1983

[51] Int. Cl.[3] ..... F01L 7/04

[52] U.S. Cl. ..... 123/81 C; 123/76

[58] Field of Search ..... 123/65 VS, 65 VA, 81 R, 123/81 C, 188 C, 76, 312

[56] References Cited

U.S. PATENT DOCUMENTS

| | | | |
|---|---|---|---|
| 1,014,270 | 1/1912 | Utz | 123/65 VA |
| 1,126,309 | 1/1915 | Snyder | 123/76 |
| 1,169,354 | 1/1916 | Reeve | 123/188 C |
| 1,196,158 | 8/1916 | Sawtelle | 123/312 |
| 1,969,816 | 8/1934 | Meyer | 123/81 C |
| 1,983,699 | 12/1934 | Kinnucan et al. | 123/81 C |
| 1,996,919 | 4/1935 | Harris | 123/81 C |
| 1,999,512 | 4/1935 | Meyer | 123/81 C |
| 2,047,998 | 7/1936 | DuBois | 123/81 C |
| 2,197,107 | 4/1940 | Kammer | 123/65 VA |
| 2,691,970 | 10/1954 | Evans | 123/81 C |
| 4,173,203 | 11/1979 | Nakajima | 123/76 |
| 4,194,473 | 3/1980 | Hidaki | 123/76 |

FOREIGN PATENT DOCUMENTS

| | | | |
|---|---|---|---|
| 622626 | 12/1935 | Fed. Rep. of Germany | 123/312 |
| 28061 | of 1910 | United Kingdom | 123/312 |
| 3412 | of 1910 | United Kingdom | 123/312 |
| 18140 | of 1910 | United Kingdom . | |
| 14629 | of 1910 | United Kingdom . | |

*Primary Examiner*—Ira S. Lazarus
*Assistant Examiner*—R. S. Bailey

[57] ABSTRACT

A single-sleeve valve engine has narrow quasi-elliptic sleeve motion which improves exhaust and intake valving and permits the conversion of standard engine blocks. The sleeve is thick walled, and is molded of low density material which permits significant rounding of the sleeve apertures for better flow, and grooves and rings for oil control, gas leakage reduction, and mass reduction. The sleeve has an extension which projects above the head and is connected to a half-speed crankshaft by means of a connecting rod. This connecting rod is restrained at an intermediate point by a radius rod to obtain quasi-elliptic sleeve motion which has an amplitude approximately half as great circumferentially as axially. In order to minimize emissions, provision is made for swirl, scavenging, multiple spark plugs, and a near ideal combustion chamber shape.

7 Claims, 8 Drawing Figures

SLEEVE VALVE INTERNAL COMBUSTION ENGINE

BACKGROUND OF THE INVENTION

This invention relates to a four-cycle spark ignition internal combustion engine having, for each cylinder, a single sleeve which reciprocates and rotates to open and close intake and exhaust passages.

Sleeve valve engines have historically produced high efficiency, partly due to low friction, with excellent durability and power. To these, this invention introduces the characteristic of low pollution emissions by exploiting its ability to:

a. induce high turbulence with no squish area and low pumping losses,
b. incorporate more well-placed spark plugs,
c. utilize an optimally shaped combustion chamber,
d. provide a uniformly warm combustion chamber without knock and $NO_x$ problems due to the presence of a very hot exhaust poppet valve and the hot combustion chamber area surrounding it, and
e. readily incorporate scavenging.

PRIOR ART

Regarding a four-cycle spark-ignition internal combustion engine having one sleeve which simultaneously reciprocates and rotates about its axis to provide intake and exhaust valving, work was confined to England inasmuch as the initial patents of McCollum (1909–14629) and Burt (1909–18140) were uncontested, and all known engines built of this type closely conform to the Burt specification.

A multitude of patents have been taken out since 1909 seeking to make detail improvements in the basic Burt design. These can largely be divided into three groups:

a. those seeking to eliminate problems having to do with the sealed space above the sleeve which, in the Burt design, tends to accumulate sludge and carbon,
b. those proposing various mechanisms to drive the sleeve in a path similar to that described in the initial Burt design, and
c. those seeking to improve intake passages.

The engine described in the McCollum specification has no practical value because the piston is contained in a stationary watercooled sleeve, with the sleeve valve outside. Thus the substantial volume created by the intake and exhaust passages between the sleeve valve and the cylinder becomes involved in the combustion process, with obviously poor results. This is much different than an engine in which the piston is directly contained by the sleeve, thereby eliminating deleterious side passages in the combustion chamber.

The original Burt patent (1909–18140) and all subsequent related patents confine themselves to crankcase mounted mechanisms to operate the sleeve valve in near circular motion. This motion is tied to the Burt concept of moving the sleeve diagonally downward along an arc into engagement with the exhaust port, and then almost circumferentially across a blank area in the upper part of the cylinder until the exhaust passage is almost closed before sweeping diagonally upward across the intake passage. One shortcoming of this system is that a significent part of the circumference is used for the transitional blank area rather than for the critical exhaust opening and intake closing phases.

Thus an engine with an overhead mechanism imparting narrow elliptic motion to obtain more efficient utilization of the upper cylinder circumference is substantially different than the Burt specification, and the only characteristic in common with both the Burt and McCollum specifications is that the sleeve both reciprocates and rotates.

Specifications are also noted for poppet valve engines incorporating scavenging, and those having multiple spark plugs for fast burning.

SUMMARY OF THE INVENTION

One of the principal objects of the present invention is to provide an internal combustion engine having a piston that reciprocates in a cylinder formed by a sleeve, with the cylinder being supplied with a combustible mixture and discharging the products of combustion through apertures in the sleeve. Another object is to provide an engine of the type stated in a form which can convert most engine blocks and crankshafts originally designed for poppet valve engines.

An additional object is to provide an engine of the type stated with improved ability to rapidly open the exhaust passages, and to rapidly close the intake passages at the end of the intake process. A further object is to provide an engine of the type stated with improved flow at the entrance to the exhaust passages. Still another object is to provide an engine of the type stated with a means of including loop scavenging, which can reduce coolant load, and add air or cooled combustion products to the hot combustion products left at the end of the exhaust stroke, and add air to the exhaust flow. Yet another object is to provide an engine of the type stated with a means of obtaining a high level of swirl and turbulence in the combustion chamber with minimal pumping loss and no squish area. A further object is to provide an engine of the type stated which has oil and gas seals and lightening grooves in the sleeve. Still another object is to provide an engine of the type stated which has a mechanism to move the sleeve in a quasi-elliptic path in which the motion is approximately twice as much axially as circumferencially.

The present invention resides in a reciprocating type engine in which the exhaust and intake valving is embodied in a sleeve that is operated by an overhead shaft turning at half of engine speed, and said sleeve whose walls are thick enough to include oil sealing rings, gas sealing grooves, and substantial flow improvement by rounding certain edges of the apertures. The sleeve is fabricated from material fractionally as dense as cast iron. For example, die cast aluminum with a coating compatible with the piston and block, of which several are available, including low friction polymer. Also, it can be molded primarily from a polymer with metal inserts and high strength and stiffness fiber reinforcement. A set of apertures in the sleeve align with exhaust passages during the portion of sleeve motion near peak velocity almost straight down. The major portion of each sleeve aperture then crosses circumferentially below the exhaust passage and comes up to align with the intake passage, subsequently closing it while traveling linearly upward at near peak velocity. The rate of exhaust area production and peak exhaust area can be higher than that of the Burt sleeve valve design. The rate of intake closing can be greater, and peak intake area can either be very large for high speed operation, or optimized for low speed operation.

Having an abundance of efficient exhaust area, one or more potential exhaust passage positions can be diverted for use as loop scavenging passages by lowering their upper edges so that they begin to open as the piston reaches the end of the power stroke, and by separating them from the exhaust passages. The scavenge passages are aimed downward so that the momentum of the scavenge gas will carry it toward the piston before turning upward as it is pulled along by the momentum of the preceding high speed exhaust flow. A pressure actuated valve in the scavenge passage will, if required, prevent back flow as the piston moves further upward after scavenging is ended.

Inlet passages can be set less or more tangential to the sleeve to obtain less or more swirl in the cylinder.

The invention also consists in the parts and in the arrangements and combinations of parts hereinafter described and claimed.

BRIEF DESCRIPTION OF THE DRAWINGS

In the accompanying drawings which form part of the specification and wherein like numerals and letters refer to like parts wherever they occur.

FIG. 6(*b*) similar to FIG. 6(*a*), but at the beginning of the intake stroke, and indicating the corresponding position of the piston top.

FIG. 6(*c*) similar to FIG. 6(*a*), but at the end of the intake stroke.

DESCRIPTION OF THE PREFERRED EMBODIMENT

Figure 1:
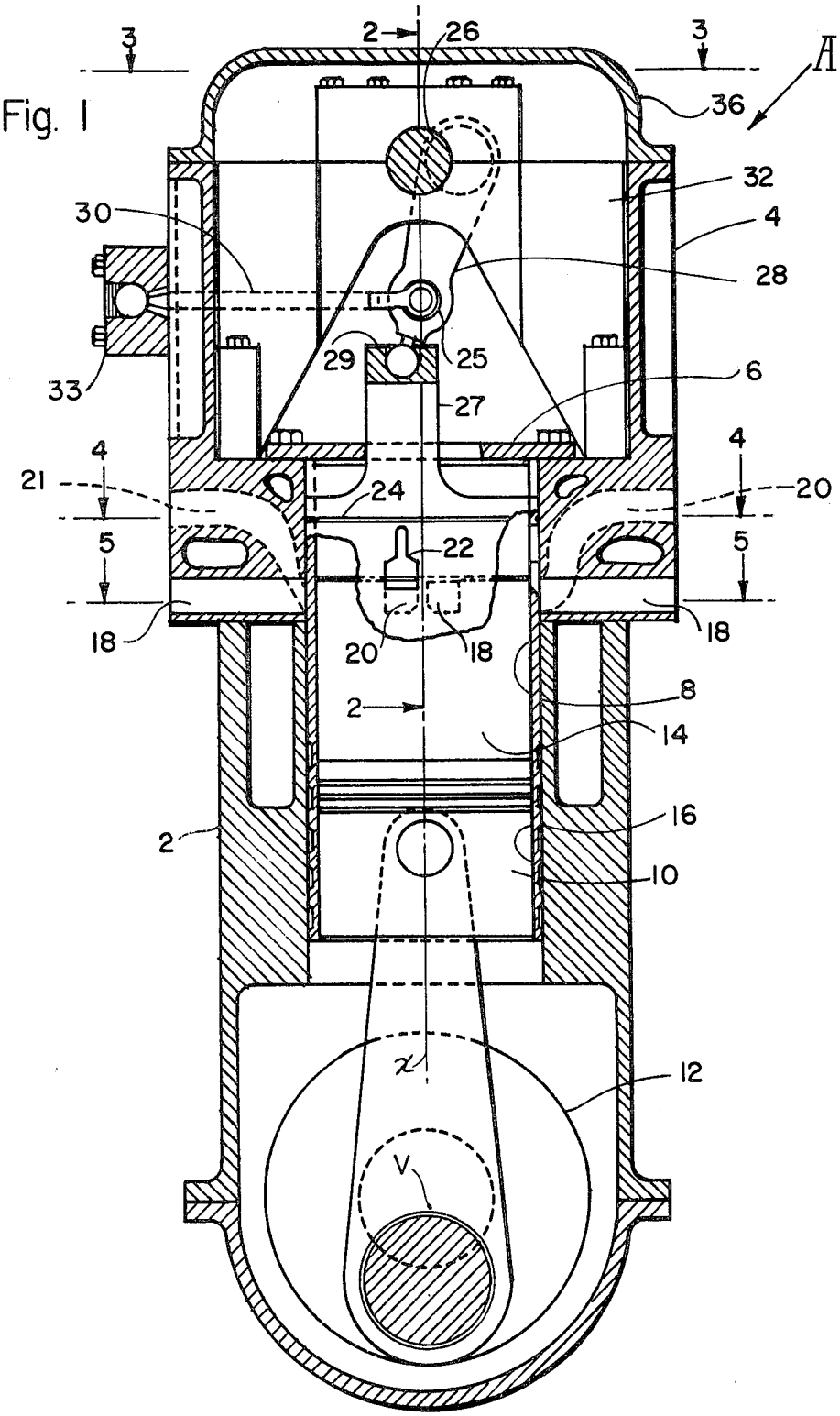
FIG. 1 is a full sectional view in elevation of an internal combustion engine constructed in accordance with and embodying the present invention.

Referring now to the drawings, an internal combustion engine A of the reciprocating variety operates on four strokes per cycle with spark ignition. The engine A basically includes (FIG. 1) a block and crankcase 2, which can be from a common poppet valve engine, a block extension 4, which might be cast integrally with block 2, if mass production takes place, a sleeve 8, which reciprocates and rotates about its axis in the block 2, a piston 10, that reciprocates in the sleeve 8, and a crankshaft 12, located within the crankcase where it is connected to the piston 10, the sleeve in effect forms a cylinder 14, which is closed at the end opposite the crankshaft 12, by the head 6.

A combustible mixture is introduced through multiple intake passages 18, into the cylinder 14, and that mixture upon being compressed and ignited drives the piston 10 along its axis X away from the head 6, causing the crankshaft 12 to turn about its axis V.

The bore 16 is machined concentrically in the block 2 and block extension 4. The fit between the bore 16, and the sleeve 8, is such that the sleeve is free to slide and rotate in the bore 16, yet does not wobble within the bore 16.

Figure 4:
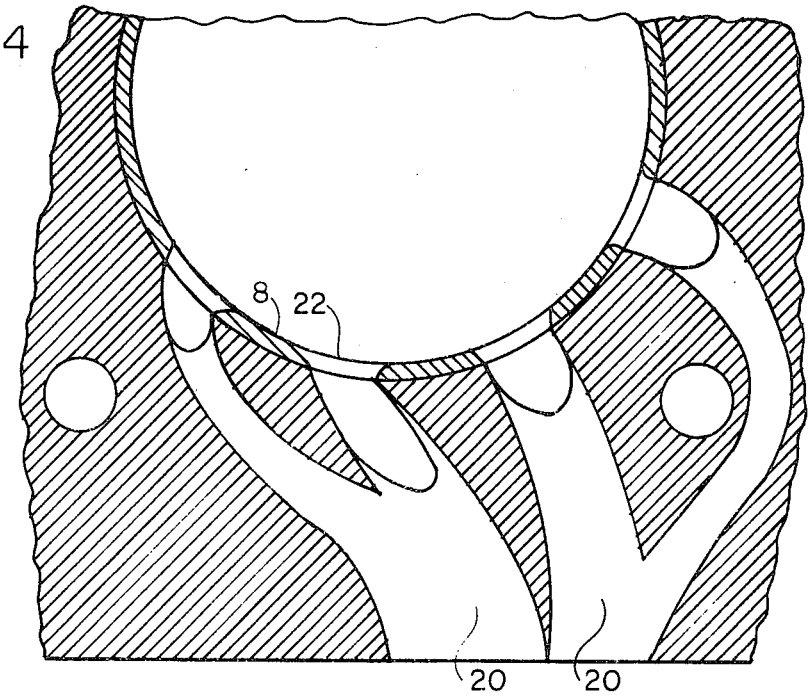
FIG. 4 is a sectional view taken along line 4—4 of FIG. 1 and showing a plan view of a set of exhaust ports at a scale double that of the above figures.
Figure 5:
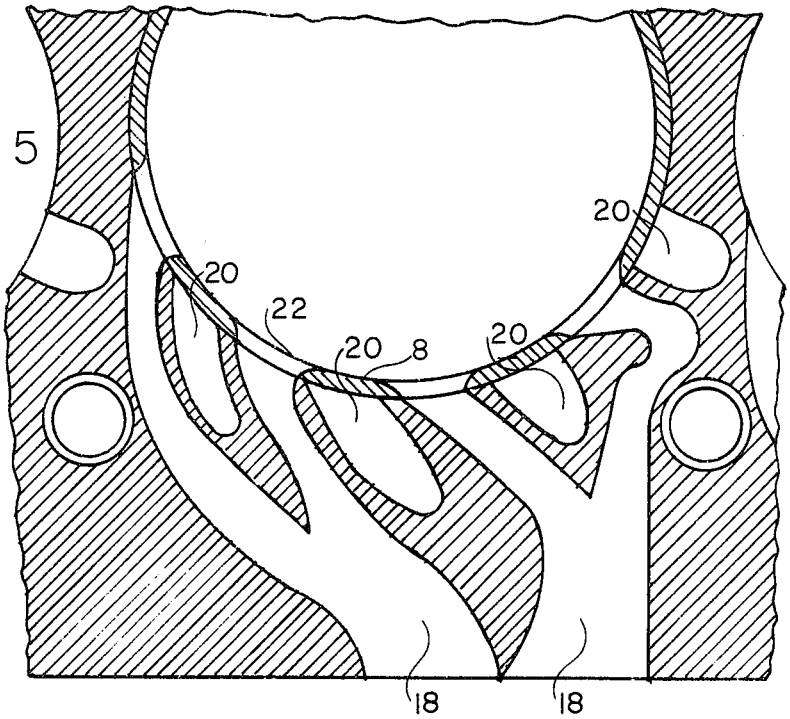
FIG. 5 is a sectional view taken along line 5—5 of FIG. 1 and showing a plan view of a set of intake ports at a scale double that of the FIGS. 1–3.

Intake passages 18, can be set less or more tangential to bore 16 (FIG. 5) to obtain less or more swirl as required to aid the combustion process. Intake passages 18 are gathered together to form one passage (FIG. 5), within block extension 4, in order to simplify external manifolds. Exhaust passages 20 are also gathered together within block extension 4, (FIG. 4).

Within the block extension 4, near the block 2, are contained intake passages 18 and exhaust passages 20, The opening of each intake passage 18 into the bore 16 is identical, as is the opening of each exhaust passage. One intake passage opening plus one exhaust passage opening set next to each other and sucessively opened and closed by one sleeve aperture 22 constitute one pair, and several pairs are arranged around the circumference of bore 16 according to available space and engine flow requirements.

Figure 6:
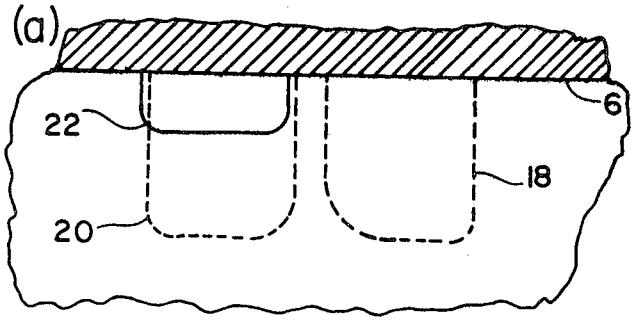
FIG. 6(*a*) is a view of the position of one sleeve aperture relative to a pair of exhaust and intake ports, at the beginning of the exhaust stroke at four times the scale of FIGS. 1–3.
Figure 6:
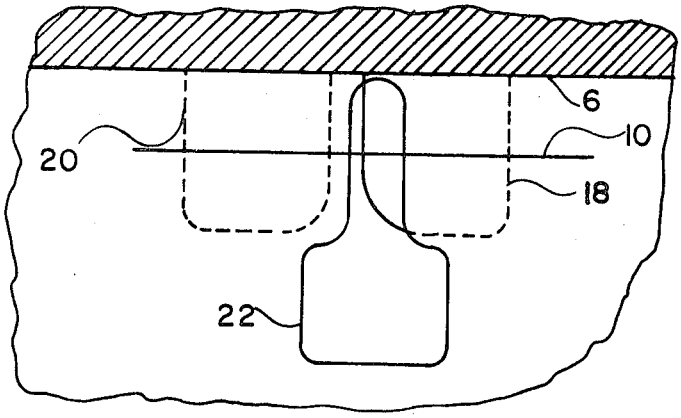
Figure 6:
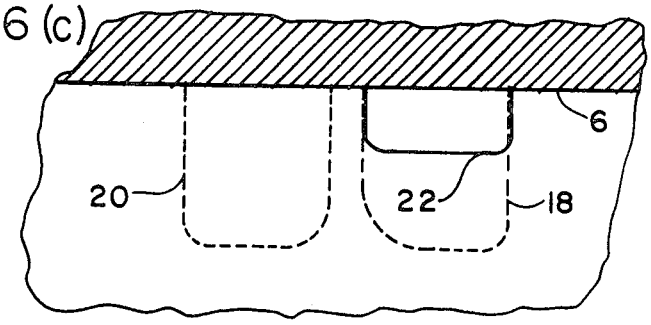

The sleeve 8 is somewhat shorter than the bore 16 into which it fits so that the sleeve 8 is capable of moving upward and downward between the upper sealed position and the lower exhaust and intake positions. Also, the sleeve 8 is capable of oscillation or rotation about its longitudinal axis X to move from the exhaust passage 20 opening to the intake passage 18 opening (FIGS. 6*a,b,c*).

Figure 2:
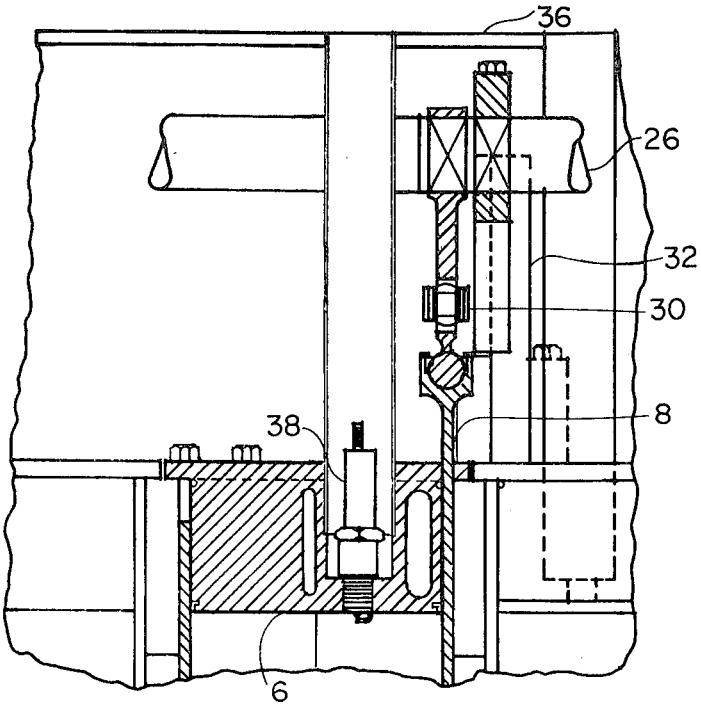
FIG. 2 is a sectional view taken along line 2—2 of FIG. 1 and showing in elevation the mechanism for operating the sleeve valve.
Figure 3:
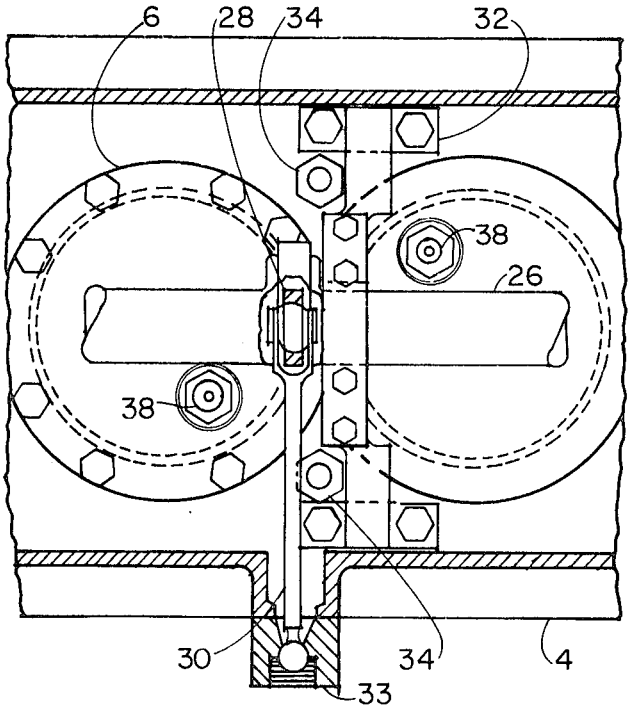
FIG. 3 is a sectional view taken along line 3—3 of FIG. 1 and showing a plan view of the sleeve drive mechanism.

Along its upper margin, the sleeve 8 is provided with an axial extension 27 (FIGS. 1,2), which projects upward past the head 6 where it is provided with a spherical socket to accept the spherical end of the sleeve connecting rod 28, and the spherical bearing retainer 29.

Sleeve connecting rod 28 has a spherical bearing at its upper end and is driven by sleeve crankshaft 26, which turns at half crankshaft 12 speed, and is phased properly to coordinate intake and exhaust events with the piston 10 positions. Sleeve crankshaft 26 is free to turn in bearings provided in the sleeve crankshaft bracket 32 which is fastened firmly to block extension 4. Block extension 4 is fastened firmly to block 2 by what would normally be the head bolts or studs, or is cast integrally with block 2, as mentioned above.

Intermediate spherical bearing 25 is located approximately two thirds of the way down sleeve connecting rod 28, and is restrained to an arc whose plane is essentially tangential to the surface of projection of the sleeve 8 by sleeve radius rod 30. The outer end of sleeve radius rod 30 is spherical and free to pivot in bearing block 33, which is fastened firmly to block extension 4.

The mechanism consisting of sleeve crank 26, sleeve connecting rod 28, and sleeve radius rod 30, produces a quasi-elliptic motion of sleeve 8 (FIG. 6) approximately twice as long axially as circumferentially.

Various mechanisms can impart sleeve motion sufficiently near the ideal, but the mechanism illustrated is relatively simple and economical, especially for the conversion of existing engine blocks. If, however, a completely new engine is to be designed, it may be more convenient to locate a mechanism in the crankcase which produces similar sleeve motion, although historically many of the problems encountered with the single-sleeve engine have involved the space in the head provided for sleeve motion which is sealed off from the rest of the engine when crankcase sleeve drive is used.

Sleeve aperture 22 is shaped to engage a large area quickly at the beginning of the exhaust process, with the narrow upper portion (panhandle) providing transition to the intake process, (FIGS. *6a,b,c*). The width of the panhandle relative to the distance between exhaust and intake passages primarily determines the overlap between exhaust and intake. At the end of the intake process the inlet area goes rapidly from full open to closed. The inner vertical edges of sleeve aperture 22 are rounded (FIG. 4) using a radius approximately equal to the thickness of the sleeve 8 in order to improve the orifice efficiency. Also, these radii make the effective port opening larger at the beginning of exhaust flow and at the end of intake flow, thus making the exhaust opening and intake closing more abrupt.

The outer bottom edge of sleeve aperture 22 is also rounded to improve intake flow while the sleeve port 22 is closing.

Grooves may be placed near the sleeve aperture 22 in the outer surface of sleeve 8 in order to minimize gas flow along the surface of the cylindrical bore 16. Also, circumferential grooves may be molded into the lower outer surface of the sleeve to reduce its mass.

Scavenge passage 21 is a passage separated from both the intake and exhaust passages. The sleeve aperture axial location and passage height are designed to cause this port to open later in the cycle than the exhaust port. Scavenge passage 21 is connected either to a filtered fresh air source or a cooled exhaust gas source. A pressure actuated reed valve (not shown), just beyond the block extension 4, would prevent flow outward in scavenge port 21, if required. The exhaust gas flow momentum will pull scavenge gas into the cylinder during part of the exhaust stroke of the piston.

Spark plug 38 is shown in typical positions associated with four spark plugs per cylinder. As many as five can be used, with the fifth one near the centerline of cylinder 14, and electrical switching can be used to vary the number being used at any given moment in order to vary the combustion duration.

What is claimed is:

1. A four cycle, single sleeve internal combustion engine comprising:

a block having a bore and a plurality of exhaust and intake passages that open into the bore;

a single sleeve located within said bore to form a cylinder, said sleeve having apertures and being mounted within said bore for rotation within and axial movement along said bore to selectively bring said apertures into and out of alignment with said exhaust and intake passages;

a piston slidably mounted within said sleeve; a crankshaft mounted for rotation about an axis that is fixed in position with respect to the block; a connecting rod connecting said piston and crankshaft whereby said piston moves axially along said sleeve as crankshaft revolves, a head fixed to said block and closing the end of said sleeve remote from said crankshaft;

a sleeve valve actuating mechanism comprising of:

a valve crankshaft mounted above the head for rotation parallel to the said crankshaft and driven at half speed;

an extension of the said sleeve extending through the head;

a valve connecting rod connecting said valve crankshaft to said sleeve extension;

a radius rod lying essentially in the plane of motion of said valve connecting rod with one end connected to the said valve connecting rod approximately two thirds of the way down it, and the other end connected to said block such that the said radius rod is essentially horizontal when the sleeve is at mid-axial stroke;

the result being that as the valve crankshaft turns at half speed, the sleeve moves in a quasi-eliptical path, said sleeve apertures are moved approximately twice as far in the axial direction as in the circumferential direction as said apertures are aligned with said intake and exhaust passages during engine cycle.

2. The engine as claimed in claim 1 wherein the block comprises:

a lower portion to which said crankshaft is mounted and which is essentially the same as, or derived from, any poppet valve engine block; and an extension containing the said exhaust and intake passages, the said head, the said sleeve actuating mechanism and a bore which extends the bore of the said poppet valve engine block, and which is bolted to the said poppet valve engine block;

thus converting an existing poppet valve engine to said sleeve valve engine.

3. The engine as claimed in claim 1 wherein the said sleeve is fabricated of material having a density less than half of that of iron, thereby allowing a thicker sleeve.

4. The engine as claimed in claim 1 wherein said sleeve apertures have certain edges rounded to improve flow through the aperture.

5. The engine as claimed in claim 1 wherein said sleeve incorporates one or more oil control rings.

6. The engine as claimed in claim 1 wherein said sleeve incorporates one or more lightening grooves.

7. The engine as claimed in claim 1 wherein one or more scavenging passages is incorporated.

* * * * *